US006288678B1

(12) United States Patent
Giannetti

(10) Patent No.: US 6,288,678 B1
(45) Date of Patent: Sep. 11, 2001

(54) PATH FINDER ANTENNA

(75) Inventor: Adriano Giannetti, Grottaferrata (IT)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/530,392

(22) PCT Filed: Oct. 28, 1997

(86) PCT No.: PCT/IT97/00265

§ 371 Date: Aug. 15, 2000

§ 102(e) Date: Aug. 15, 2000

(87) PCT Pub. No.: WO99/22423

PCT Pub. Date: May 6, 1999

(51) Int. Cl.[7] ..... H01Q 1/38

(52) U.S. Cl. ..... 343/700 MS; 343/711; 342/359

(58) Field of Search ..... 343/700 MS, 711–717, 343/876; 342/359, 360, 361; 370/351; 340/989

(56) References Cited

FOREIGN PATENT DOCUMENTS

| | | | |
|---|---|---|---|
| 0 732 816 | 9/1996 | (EP) | H01Q/3/24 |
| 0 796 024 A | 9/1997 | (EP) | H04Q/7/36 |
| WO 96 29836 A | 9/1996 | (WO) | H01Q/3/00 |

OTHER PUBLICATIONS

Arnott R et al, "Development of an Adaptive Antenna Demostrator for DECT", *IEEE Colloquium On Smart Antennas*, No. 182, Dec. 9, 1994.

Horneffer M et al, "Directed Antennas in the Mobile Broadband System", *Proceedings of the IEEE Infocom 1996*. Conference on Computer Communications, Fifteenth Annual Joint Conference of The IEEE Computer and Communications Societies. Networking The Next Generation San Francisco, Mar. 24–28, 1996, vol. 2, No. Conf. 15, Mar. 24 1996, Institute of Electrical and Electronics Engineers, pp. 704–712.

*Primary Examiner*—Don Wong
*Assistant Examiner*—Hoang Nguyen
(74) *Attorney, Agent, or Firm*—Nixon & Vanderhye, P.C.

(57) ABSTRACT

An antenna for cellular telephone communications systems, particularly intended for base stations (RPF) of DECT standards, which is able to search for the best path to the user, is formed as a multimode, adaptive, dual antenna, apt to take up both a narrow lobe configuration, with variable orientation on a horizontal plane, and an omnidirectional configuration on a horizontal half-plane, the two antennas composing said dual antenna being similar, integrated onto the same dielectric substrate, and working simultaneously with two different roles (traffic support; search for optimal orientation), said roles being exchanged at every receipt-transmission cycle.

9 Claims, 5 Drawing Sheets

"Narrow Lobe" Configuration against Interference

RADIATION PATTERN on Horizontal Plane

-3 dB Angle = 40°
Gmax >= 13dBc
Tilt = -3°

Circular Polarization

"Narrow Lobe" Configuration Variable Orientation

RADIATION PATTERN on Horizontal Plane

-3 dB Angle = 40°
Gmax >= 13dBc
Tilt = -3°

Circular Polarization

"Omnidirectional" Configuration in Half Horizontal Plane

RADIATION PATTERN on Horizontal Plane

-3 dB Angle = 150°
Gmax >= 7dBc
Tilt = -3°

Circular Polarization

PATH FINDER ANTENNA

It is well-known that the so called CTM (Cordless Terminal Mobility) has been recently more and more developed in the telephone field, due to the extension to a whole town of the function of DECT (Digital Enhanced Cordless Telecommunication) apparatuses—namely of cordless telephone apparatuses which function in confined areas—achieved by means of a direct connection to central apparatuses of the fixed network.

It is also well-known that the DECT standard, which was created for small areas and for indoor use, reaches its limits when employed in large areas and outdoors.

The low power of the radio signal is one of the most obvious limitations. The weakness of such a signal together with the use of a relatively high frequency, meaning a high likelihood of reflections and interferences, makes communication precarious as soon as the distance between the base station RFP (Radio Fixed Part) and the user's Mobile PP (Portable Part) increases.

The interference to be taken into account in the DECT standard is not caused by signals with the same frequency, coming from different base stations, as in the GSM standard.

This is because the choice of the transmission frequencies is made automatically and dynamically by the RFP-PP system, by sensing the frequencies used by adjacent systems, using a different frequency, so as to avoid at the beginning this kind of interference. (The synchronism between base stations, typical of the DECT standard, ensures the correct sensing of the frequencies already used).

Destructive interference in the DECT standards is determined by signals coming from the same source, with the same amplitude, but reaching the antenna with opposite phase: this is caused by the existence of multiple signal paths from the transmitter to the receiver, characterized by reflections in different directions, with different path lengths, but with a similar attenuation.

Communication by reflection is particularly relevant in DECT standards, because of the high frequency used (the wavelength is comparable with the size of objects present in the town environment) and of the comparatively low location (4–6 meters) of base stations from the ground, that does not allow the illumination of users from above.

The presence of common obstacles, like buildings, trees and vehicles, leads to very diversified multiple paths, with a high likelihood of phase shifts and delays. Small changes in the PP position (of the order of a few wavelengths) are sufficient to come out of the opposite phase condition, and thus of interference, or to get into it. This is the reason why is it not uncommon to see DECT users moving and turning the PP in an attempt to obtain the best signal (i.e. with the highest power and free from interferences).

The solutions adopted in existing installations consist in reducing the area covered by a single base station RFP, to enhance the average level of the available radio signal, and in making use of the so called "antenna diversity" to obviate interferences.

However, to reduce the area covered by a single RFP means increasing the number of the RFP required by the system, with evidently higher installation and maintenance costs.

The antenna diversity is obtained by making use of two antennas positioned at least two wavelengths apart, if their polarization is the same, or even less if their polarization is different. Such diversity should ensure that, in case the signal received by one antenna is attenuated by reflected, interfering signals, the other antenna receives a signal that can be utilized, because of different geometric conditions leading to different interference conditions.

The use of polarization diversity (vertical polarization and horizontal polarization) to obtain antenna diversity cannot be avoided if both antennas have to be contained within the same case as the electronic part, and if the overall dimensions of the whole base station have to fulfil market requirements (maximum dimension below 300 mm and volume below 5 liters).

On the other hand, the polarization of the wave impinging on the RFP antennas cannot be predicted (because it is determined by the PP orientation and the effects of consecutive reflections). Therefore, a linearly polarized antenna is not always able to receive the maximum of the available field: from this point of view, a circular polarization antenna is certainly more effective.

The best use of the antenna diversity, however implemented, is now the object of much research, aiming at the development of algorithms, mainly based on statistical models of the environment in which the RFP's will operate.

Of course, following this route, any possible solution which might be reached will suffer from a close dependence on the environment and be affected by the precariousness of the statistical data.

The present invention follows a totally different route—and fully original, at least in the DECT technology—which is based on the idea of letting the antenna of base stations search for the best communication, which search is nowadays carried out by the user in difficulty.

To realize such an idea, it has been observed that the search for the best communication is normally carried out by the user by altering the geometric configuration of the RFP-environment-PP system, by moving and turning the PP, and by making use of the information resulting from these changes. By perfect analogy, the RFP must change the configuration and the orientation of its antenna to search for the optimal geometric configuration of the RFP-environment-PP system, through real changes and the use of the information obtained as a consequence of the changes, rather than through statistical considerations.

In other words, it is not the user who must search for the antenna, but rather, it is up to the antenna to find and follow the user, and this can be obtained by seeking the antenna configuration which maximizes the signal and minimizes the effects of a possible interference.

The notion that the directional characteristic of the fixed base station in a mobile radio telephone system can be matched to the current location of a mobile user has been already disclosed in WO-A-o6/29836, describing a system which manages a multiplicity of elementary, narrow lobe antennas, each with different orientation, choosing time to time the elementary antenna among said multiplicity of antennas which is best orientated to be matched to the mobile station of the user.

The present invention reaches the same aim, but advantageously using, instead of a multiplicity of elementary antennas, a sole antenna consisting of a plurality of "patches", in which, varying the phase between "patch" and "patch", the orientation and the width of the antenna lobe are changed, to obtain the wished best connection with the mobile user. This antenna may be in fact omnidirectional in a horizontal half plane or be with narrow lobe and orientated in a very good way, with a reduced size, compatible with the DECT standards.

More precisely the antenna according to the present invention, intended for cellular telephone communication systems and in particular for base stations (RFP) of DECT standards is characterized in that it is formed as a multimode, adaptive, dual antenna, apt to take up both a narrow lobe configuration, with variable orientation on an horizontal plane (azimuthal plane), and an omnidirectional configuration on an horizontal half-plane, the two antennas composing said dual antenna being similar, integrated on the same dielectric substrate, and working simultaneously with two different roles (traffic support; search for optimal orientation), said roles being exchanged at every receipt-transmission cycle.

Advantageously, both said antennas forming the dual antenna consist of a set of "patches", phase shifters being interposed between them and being produced by identical technology on the same substrate.

The two component antennas may be provided on the same substrate either with discrete sets of patches and phase shifters, or with discrete sets of phase shifters and with common patches, used with different polarizations.

Circular polarizations can be used for said patches, a clockwise polarization for one antenna and a counterclockwise polarization for the other, or else a vertical polarization for one antenna and an horizontal polarization for the other.

The invention also relates to an antenna for cellular telephone communication systems which is able to search for the best path to the user matching the directional characteristic of a fixed base station to the current location of a mobile user, characterised in that is formed as a multimode adaptive single antenna consisting of a set of patches, phase shifters being interposed between them and being produced by identical technology on the same dielectric substrate, said antenna being apt to take up both a narrow lobe configuration, with variable orientation on an horizontal plane, and an omnidirectional configuration on an horizontal half-plane, so as to be able, in successive periods, to search for optimal orientation and to support the traffic.

The invention is now described in greater detail, reference being made to some preferred implementations thereof, illustrated on the accompanying drawings, wherein.

Figure 1:
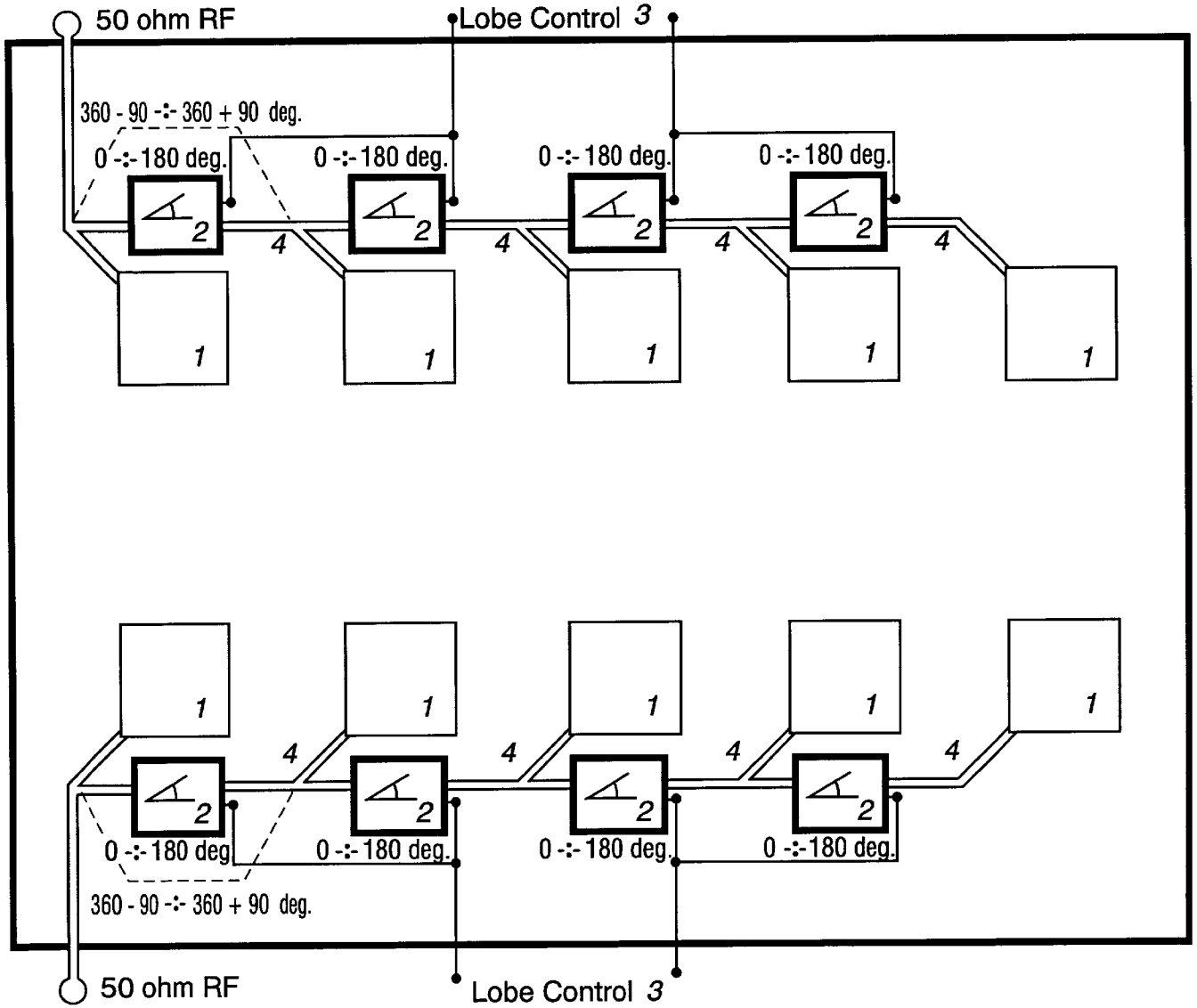
FIG. 1 shows a first, possible implementation of the antenna according to the invention.

The antenna according to the invention is a multimode adaptive dual antenna, able to take up both a narrow lobe configuration, with variable orientation on the horizontal plane, and an omnidirectional configuration on the horizontal half-plane, which consists of two similar component antennas, integrated on the same dielectric substrate and working alternatively with exchanged roles for very short periods, so as to be able to simultaneously provide both communication and search for optimal orientation (namely, the best path). A circular polarisation of the antenna is preferred.

More exactly, in a 10 ms period, the first antenna handles the traffic transmitting during the first 5 ms and receiving during the following 5 ms, while the second antenna is switched off during the 5 ms of the transmission, finding and recording the optimal orientation for each user in the next 5 ms of reception.

In the following 10 ms, the roles of the two antennas are exchanged and, while the first one searches for optimal orientation, the second one makes use of the information just obtained about optimal orientation to transmit and receive.

In this way, information on orientations is updated every 10 ms, without being affected by possible differences between the two antennas. It should be taken into account that a user, moving at a speed of 10 km/h, covers a distance of 2.8 cm in 10 ms.

FIG. 1 shows a possible first implementation of the antenna according to the present invention, with which a narrow lobe on the horizontal plane is achieved. In this implementation, the antenna extends horizontalwise on the same dielectric substrate using two discrete sets of patches and phase shifters, one set for each of the two component antennas.

Each set comprises five patches 1, connected in series, and four phase shifters 2, inserted between said patches and controlled so as to all give the same phase shift. The use of five patches is a good compromise between the performances obtained (a sufficiently narrow lobe) and the complexity and cost of the antenna.

Square patches are shown in FIG. 1, but also circular patches could be used with equally satisfactory results.

The phase shifters of both sets are controlled by two analogue inputs 3 and force a phase shift among patches that is constant over the range of useful frequency.

By introducing additional phase shifts between two consecutive patches, up to =90°, it is possible to rotate the orientation of the main lobe up to ±70°.

The phase shifters should be able to shift their phase by an extent which continuously varies from 0° to 180°.

The total phase shift, which is given by summing the phase shift introduced by the phase shifter to the one introduced by the interconnecting strip-lines 4 should vary from 360°−90° to 360°+90°: by shifting the phase between two consecutive patches up to +90°, the fourth Quadrant is covered; by shifting the phase between two consecutive patches up to −90°, the first Quadrant is covered; while, by introducing phase shifts of +90° between the first patch and the second one and between the second patch and the third one, and by introducing phase shifts of −90° between the third patch and the fourth one and between the fourth patch and the fifth one, the omnidirectional antenna is achieved.

Figure 2:
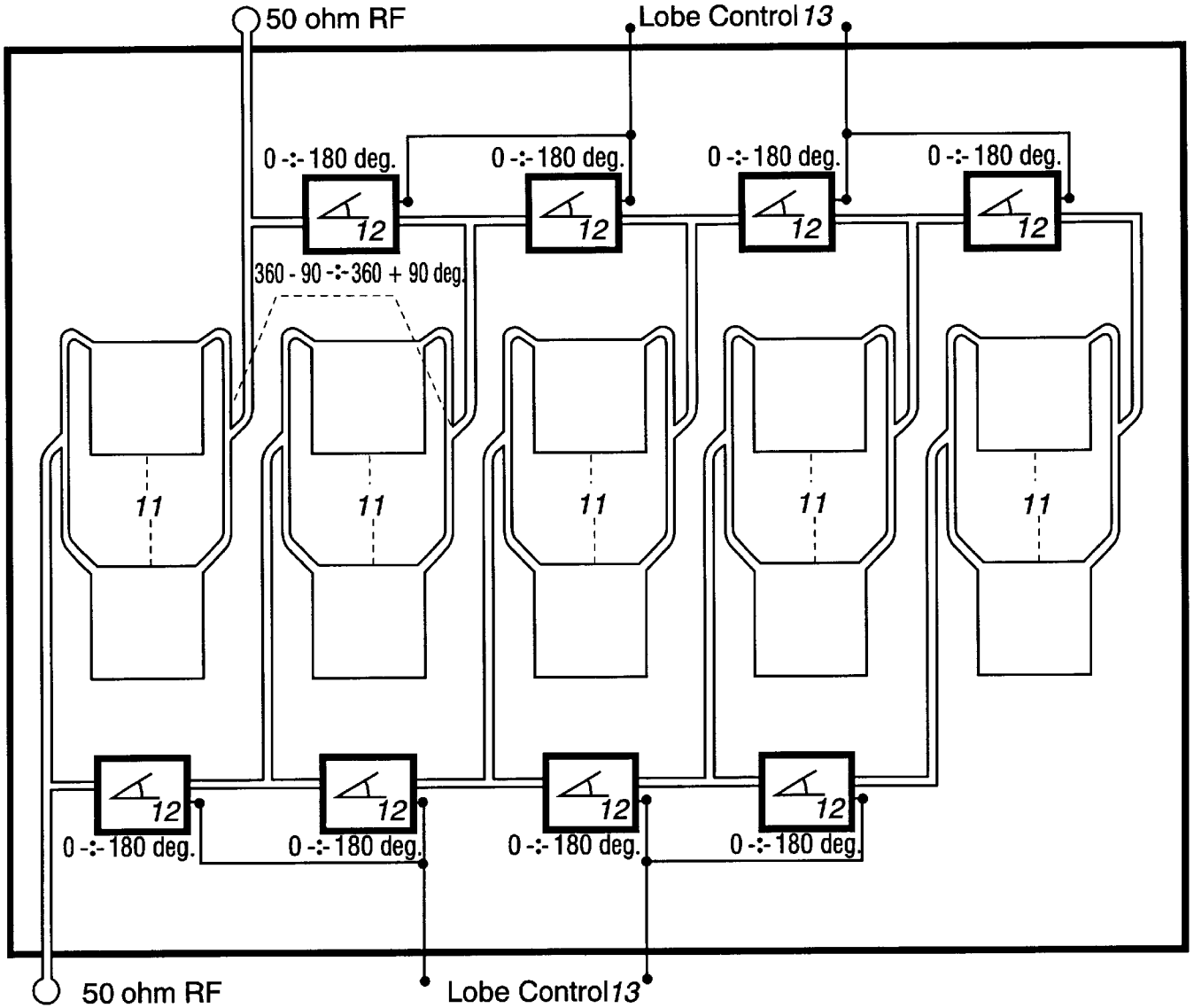
FIG. 2 shows a second, possible implementation of the antenna according to the invention.

FIG. 2 shows a second, more complex implementation of the dual antenna according the invention, wherein the two component antennas are provided on the same substrate with two discrete sets of phase shifters and common patches.

In this case, ten common patches 11 are provided, reciprocally connected as shown in FIG. 2, and two sets of four phase shifters 12 are inserted between said patches and are controlled by analogue inputs 13.

In an antenna thus conceived, all the patches are activated in circular clockwise polarization, so as to provide one component antenna, and in circular counterclockwise polarization, so as to provide the other component antenna.

Alternatively, the patches could be activated in vertical polarization for one antenna, and in horizontal polarization for the other.

The antenna shown in FIG. 2, which is more complex and thus more difficult to implement, but not much more expensive to be produced, allows to reduce the lobe width also on the vertical plan (elevation plane), and thus to increase by 3 dB the maximum gain over the antenna shown in FIG. 1.

Therefore, the antenna shown in FIG. 2 is the best implementation of this invention, because it maximizes one of the main features thereof. The irradiation diagrams shown in FIGS. 3, 4 and 5 result from a simulation of the antenna shown in FIG. 2.

It is now possible to place in evidence the results which the various features of the antenna according to the invention allows to achieve.

As to the possibility for the antenna to take up a narrow lobe configuration, with orientation variable on the horizontal plane, it should be noted that:

the narrower the lobe, the higher the antenna gain;

the narrower the lobe, the smaller the likelihood that two signals, originated from the same source, but undergoing different reflections and thus reaching the antenna with different phases, are received with the same intensity.

Figure 3:
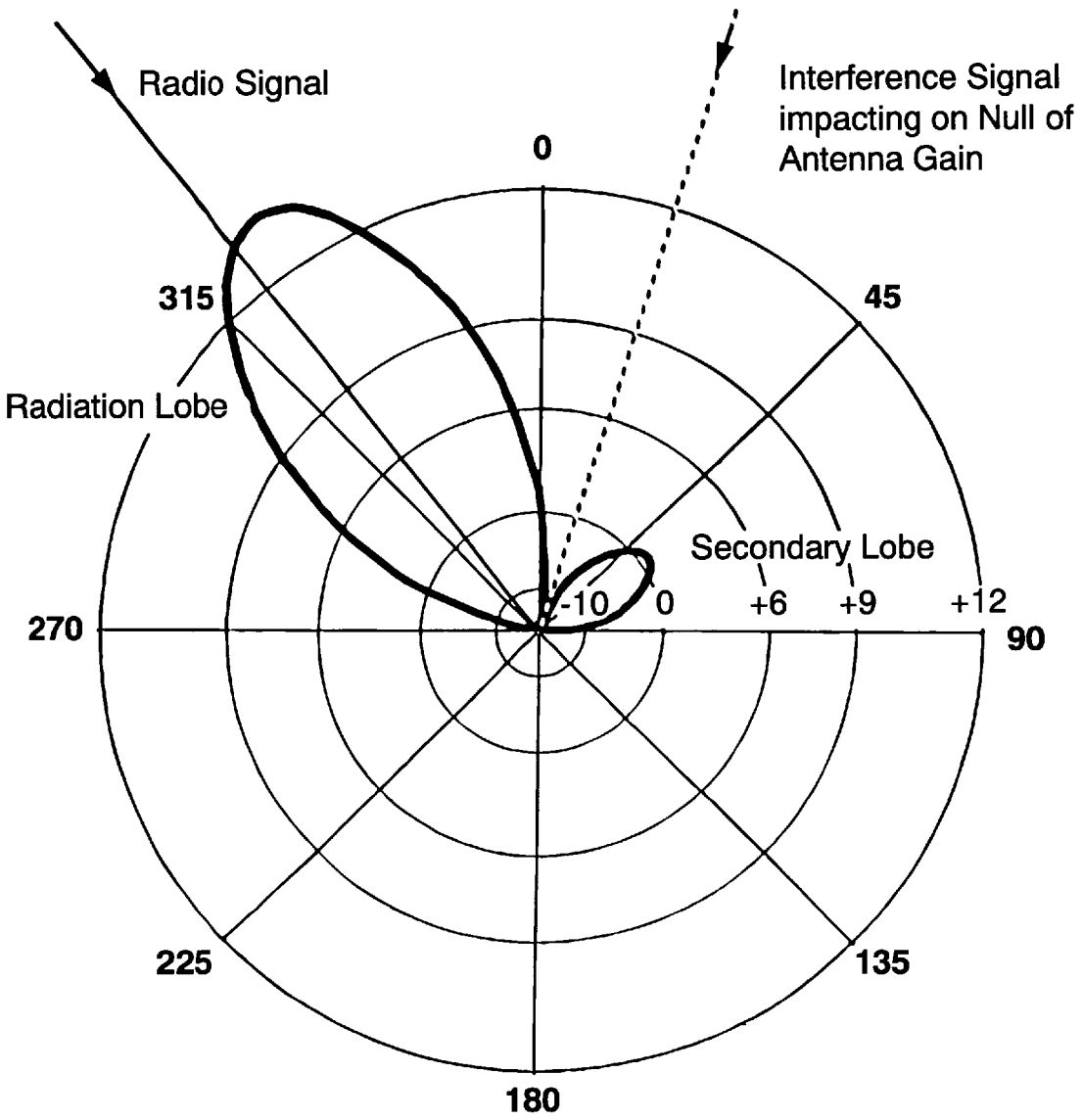
FIGS. 3 and 4 are irradiation diagrams of the antenna, taken on the horizontal plane in the narrow lobe configuration (with circular polarization), which show the removal of the interference and, respectively, the variable orientation.

If one of the signals reaches the antenna close to the direction of maximum gain, while the other comes from a direction corresponding to a null of the antenna gain, it is then obvious that the annulment of interference is achieved, as clearly shown in FIG. 3.

Figure 4:
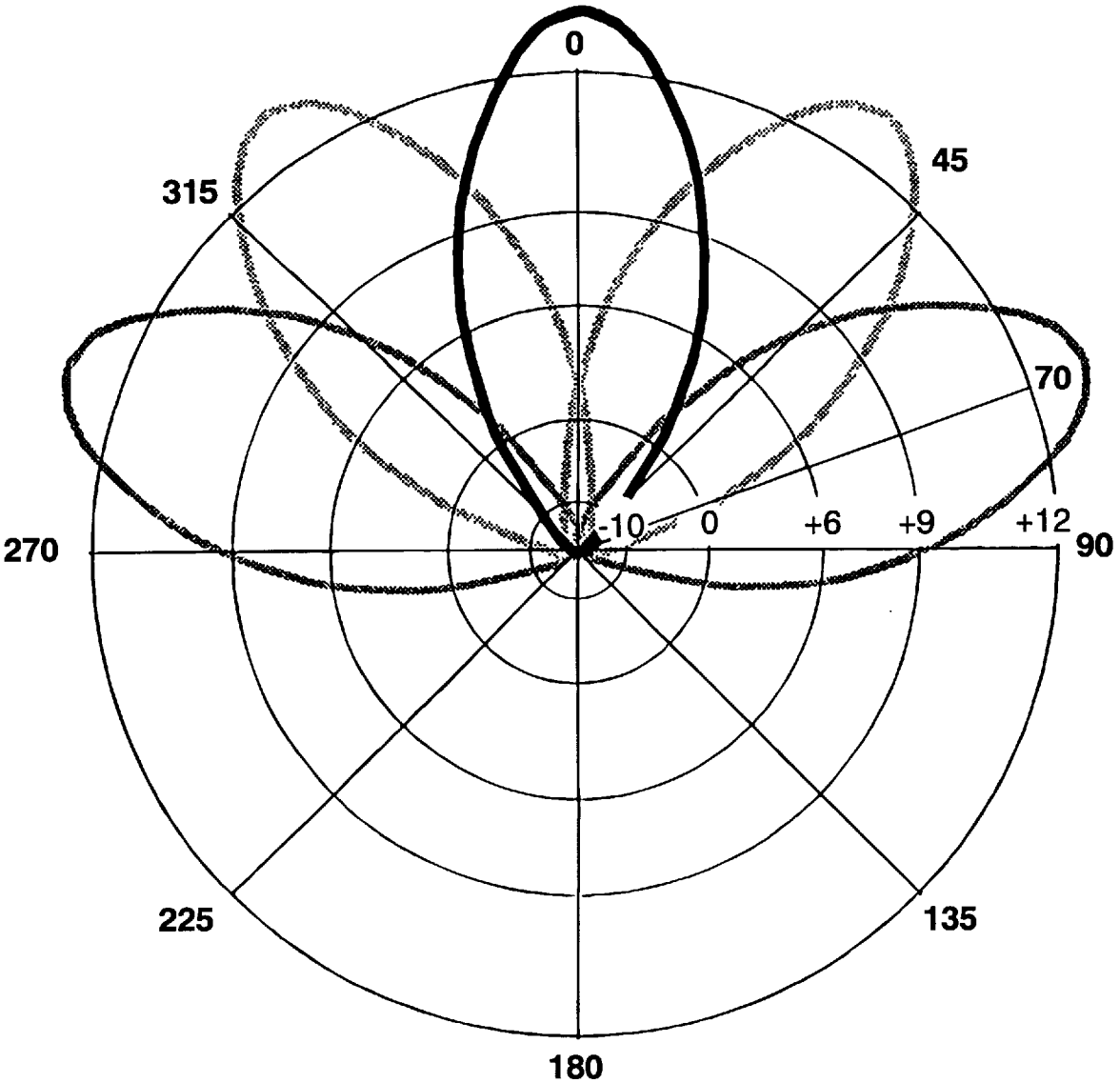

With a range of orientation change between −70° and +70° and with a lobe width of 40° at −3 dB from maximum gain, it is possible to cover all the 180° of a half-lane. FIG. 4 shows some of the possible positions of the main lobe.

Of course, with an orientation change ranging between −70° and +70°, it will not be possible to have maximum gain in all directions, but some implementation problems are thus eased. For instance:

the reduction to a suitable size of secondary lobes is easier;

the attenuation in the phase shifters, necessary to rotate the antenna, is less, and their implementation is easier and cheaper;

furthermore, although the antenna maximum gain can be oriented only between −70° and +70°, the existence of two nulls delimiting the main lobe allows to position one null in any direction between −90° and +90°; and it is always possible to position a null in the direction of the interfering signal.

Figure 5:
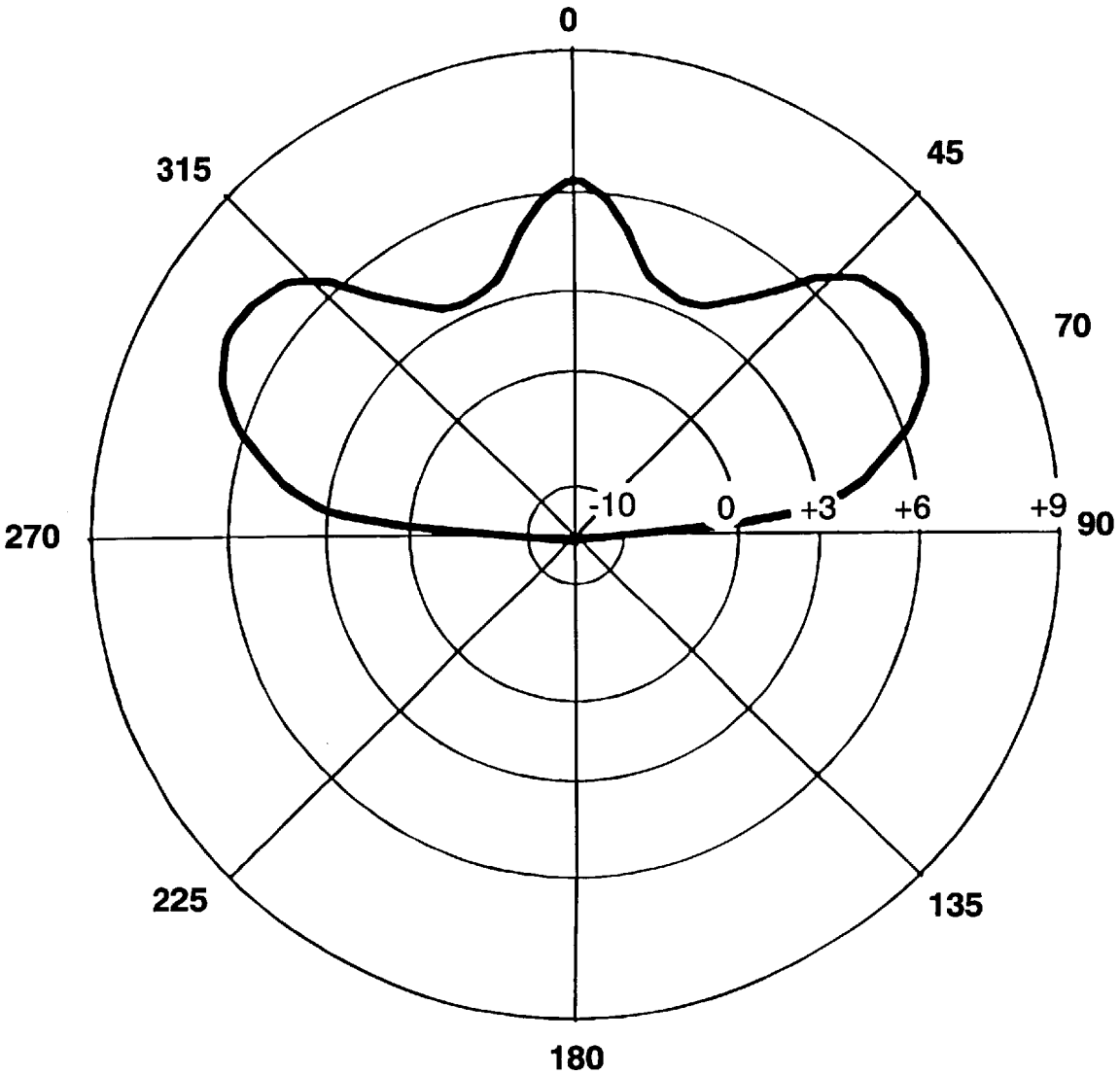
FIG. 5 is an irradiation diagram of the antenna, taken on the horizontal plane in the omnidirectional configuration (with circular polarization).

As to the possibility for the antenna to take up an omnidirectional configuration on the horizontal half-plane, it should be noted that, although a narrow and precisely oriented lobe is surely the best way to handle an ongoing link, the initial stages of "dummy bearer" transmission (to signal the presence and availability of the base station) and call setup require to respect the concept of omnidirectionality on which the DECT standard is based. Thus, the availability of an omnidirectional antenna configuration is essential. FIG. 5 shows the radiation pattern of the "Path Finder Antenna" according to the invention in omnidirectional configuration.

Of course, an important advantage of the antenna according to the invention is the possibility to simultaneously take up both the above cited configurations, by integrating two component antennas on the same dielectric substrate, said antennas being able to alternate in their function.

Finally, as to the use of circular polarization, it should be taken into account that it is common for the user to experience a change in the field strength with different orientations of his or her own portable telephone.

Circular polarization of the base station antenna is intended to eliminate these changes, making the turning of the mobile PP unnecessary and useless (since the quality of the reception is constant with any orientation of the Mobile PP) according to the philosophy of the present invention.

The reduction of antenna gain caused by the increased power needed for feeding the antenna in circular polarization should, on the other hand, be compensated (according to available literature) by the statistical gain due to its inherent capability to receive and transmit, with the most appropriate polarization, the radio signal from a PP having linear polarization and undefined orientation.

It is also appropriate to check, at least as a first approximation, the availability of a timing which is sufficient for the use of the antenna according to the present invention.

With a simple optimum criterion, like the individuation of the orientation allowing to receive the highest level of radio signal, the following assumptions for the duration of various operations can be made:

1 μs: time for antenna orientation;

3 μs: time for the measurement of the radio signal level;

2 μs: time for data estimate and recording;

Total time for a measurement: 5 μs.

In such conditions, it is possible to perform around 70 measurements for each user (a time slot cleaned from guard and synchronization bits is 388 bits, corresponding to 336 μs) and thus, even with the most naive measurement strategy, a precision of ±1° can be achieved.

A more sophisticated optimum criterion, taking into account the extent of the received data jitter (the jitter for data with a relatively high radio signal can be caused only by multiple interfering paths), as well as the level of radio signal, requires longer measurement times and more elaborated measurement strategies.

The antenna according to the invention allows considerable and evident advantages, particularly:

It enables to increase the antenna gain in all directions by at least 6 dB, in respect to the current standard solutions. In fact, as the antenna lobe on the horizontal plane has been concentrated from 180° to 40°, the corresponding increase of antenna gain is the following:

$$G.I.=10 \text{ Log } (180/40)=6.5 \text{ dB}$$

Antenna gain means, of course, maximum antenna gain, but by changing the lobe orientation this maximum is available, practically, in all directions.

As the base stations are located approximately at the same height of the PP's and in the same environment, also the conditions of environmental noise will be similar, whereby the uplink and downlink paths will be substantially similar. Therefore the optimum orientation for the uplink is the optimum orientation also for the downlink.

On the basis of the above, the goal of doubling the radius of the covered area of each base station, i.e. reducing to ¼ the number of the necessary RFP in a DECT standard, can be considered reached, at least from a theoretical point of view.

The significant reduction of the interferences, and the independence of the communication from the PP orientation (due to the circular polarization) and from the user's mobility (due to the continuous optimization of antenna orientation), provided an improvement in the quality of the service which is easy to perceive, even if difficult to quantify in terms of further increase in the radius of the coverage area.

The limited size of the antenna according to the invention (about 230×180 mm) allows to produce base stations also of limited size (much smaller than the conventional ones) with a high reduction of the visual effect and an evident aesthetical improvement.

The high gain and directivity of the path finder antenna according to the invention should also make it interesting for the RLL (Radio Local Loop) installations, as least as an inexpensive solution.

A solution more aiming at the RLL installations (substantially involving fixed users, whereby the search for optimum orientation can be temporarily limited to the "start-up" and to a periodic "refresh") could consist of a multimode adaptive single antenna, apt to search for optimum orientation and to support the traffic in successive periods, and thus engaged in the search for optimum orientation (which remains unvaried) only for a very short period, and always substantially available to support the traffic.

An antenna thus conceived would still be an antenna according to the invention, but not a dual antenna such as the one previously described and illustrated. An implementation thereof could for example be represented by a diagram corresponding to the upper half or to the lower half of FIG. 1.

A single antenna of this type could also be conveniently used, in reception, by DECT Repeaters (WRS=Wireless Relay Station).

Furthermore, it can be seen that the concepts and solutions on the basis of which the present invention has been developed can be applied to any kind of time-sharing radio communication using frequencies close to 2 GHz, the only warning being that the information of optimum orientation is available at a given instant and is used at a subsequent moment. It is important that the user's speed of movement be limited (like in the CTM case), for the information of optimum orientation to be meaningful.

What is claimed is:

1. An antenna for cellular telephone communication systems, particularly intended for base stations (RFP) of DECT standards, which is able to search for the best path to the user, matching the directional characteristic of a fixed base station to the current location of a mobile user, characterized in that it is formed as a multimode, adaptive, dual antenna, apt to take up both a narrow lobe configuration, with variable orientation on an horizontal plane, and an omnidirectional configuration on an horizontal half-plane, the two antennas composing said dual antenna being similar, integrated onto the same dielectric substrate, and working simultaneously with two different roles (traffic support, search for optimal orientation), said roles being exchanged at every receipt-transmission cycle.

2. An antenna as in claim 1, wherein both said component antennas consist of a set of patches, phase shifters being interposed between them and being produced by identical technology on the same substrate.

3. An antenna as in claim 1, wherein said two component antennas are provided on the same substrate with discrete sets of patches and phase shifters.

4. An antenna as in claim 1, wherein five patches and four phase shifters are provided for each antenna.

5. An antenna as in claim 1, wherein said two component antenna are provided on the same substrate with discrete sets of phase shifters and with common patches, used with different polarizations.

6. An antenna as in claim 5, wherein ten common patches and two discrete sets of four phase shifters are provided.

7. An antenna as in claim 1, wherein circular polarizations are used for said patches, a clockwise polarization for one antenna and a counterclockwise polarization for the other.

8. An antenna as in claim 1, wherein a vertical polarization is used for the patches of one antenna and a horizontal polarization is used for the patches of the other.

9. An antenna for cellular telephone communication systems, which is able to search for the best path to the user, matching the directional characteristic of a fixed base station to the current location of a mobile user, characterized in that is formed as a multimode adaptive single antenna consisting of a set of patches, phase shifters being interposed between them and being produced by identical technology on the same dielectric substrate, said antenna being apt to take up both a narrow lobe configuration, with variable orientation on an horizontal plane, and an omnidirectional configuration on an horizontal half-plane, so as to be able, in successive periods, to search for optimal orientation and to support the traffic.

* * * * *